US007610676B2

(12) United States Patent
Tran et al.

(10) Patent No.: US 7,610,676 B2
(45) Date of Patent: Nov. 3, 2009

(54) BUNDLE CABLE CONNECTOR ASSEMBLY, COMPONENTS, TOOLING AND MANUFACTURING METHOD

(75) Inventors: Dean Tran, Westminster, CA (US); Alan Hirschberg, Thousand Oak, CA (US); Melissa Fuller, Gardena, CA (US); Phillip Hayes, Placentia, CA (US); Greg Keller, Redondo Beach, CA (US)

(73) Assignee: Northrop Grumman Space & Missions Systems Corp., Los Angeles, CA (US)

( * ) Notice: Subject to any disclaimer, the term of this patent is extended or adjusted under 35 U.S.C. 154(b) by 262 days.

(21) Appl. No.: 11/676,467

(22) Filed: Feb. 19, 2007

(65) Prior Publication Data

US 2008/0196246 A1 Aug. 21, 2008

(51) Int. Cl.
*H01R 43/04* (2006.01)

(52) U.S. Cl. ..... 29/861; 29/867; 29/882

(58) Field of Classification Search ..... 29/857, 29/860, 861, 866, 867, 876, 882, 564.4; 439/877
See application file for complete search history.

(56) References Cited

U.S. PATENT DOCUMENTS

| | | | | |
|---|---|---|---|---|
| 3,784,963 | A | 1/1974 | DeCenzo | |
| 4,117,299 | A * | 9/1978 | Petro et al. | 219/117.1 |
| 4,266,844 | A * | 5/1981 | Chelminski | 439/460 |
| 4,272,879 | A | 6/1981 | Wigby et al. | |
| 4,641,428 | A | 2/1987 | Anderson | |
| 4,648,681 | A | 3/1987 | Pass et al. | |
| 4,690,481 | A * | 9/1987 | Randolph | 439/585 |
| 5,025,554 | A * | 6/1991 | Dohi | 29/860 |
| 5,163,852 | A * | 11/1992 | Buck | 439/578 |
| 5,619,790 | A | 4/1997 | Takanashi | |
| 5,737,835 | A | 4/1998 | Murata | |
| 6,101,712 | A | 8/2000 | Wright | |
| 6,281,443 | B1 * | 8/2001 | Idler | 174/110 R |
| 6,568,075 | B1 | 5/2003 | Yamakawa | |
| 6,643,926 | B2 | 11/2003 | Sakaguchi et al. | |
| 6,658,725 | B1 | 12/2003 | Liu | |
| 6,742,251 | B1 | 6/2004 | Fukase | |
| 6,815,617 | B1 * | 11/2004 | Gebs et al. | 174/113 AS |
| 7,010,857 | B2 | 3/2006 | Gloaguen | |

* cited by examiner

*Primary Examiner*—David P Bryant
*Assistant Examiner*—Dhanvir Aujla
(74) *Attorney, Agent, or Firm*—John A. Miller; Miller IP Group, PLC

(57) ABSTRACT

A method for assembling a bundle cable connector assembly that eliminates bird caging, wire threads extruding through a connector pin, loose wire threads, dielectric shield shrinking, etc. The method includes stripping the wire to create a bird-cage preventative zone and an exposed tip with a crimping zone therebetween, and tinning the exposed wire at the bird-cage preventative zone and the tip. The method then includes inserting the wire into a connector pin, and crimping the pin to the wire at the crimping zone using heat so that the tinning solder melts. The method then includes mounting the pin to a connector body and mounting a wire-locking device to the connector body to lock the pin to the connector body.

20 Claims, 5 Drawing Sheets

BUNDLE CABLE CONNECTOR ASSEMBLY, COMPONENTS, TOOLING AND MANUFACTURING METHOD

BACKGROUND OF THE INVENTION

1. Field of the Invention

This invention relates generally to a bundle cable connector assembly and, more particularly, to a method for assembling a bundle cable connector assembly that includes assembly steps for eliminating bird caging, stray wires, dielectric shielding shrinkage, etc.

2. Discussion of the Related Art

A bundle cable connector assembly is an electrical wire connector that allows one or more wires to be electrically coupled to one or more other wires through another bundle cable connector assembly, where each wire is typically a plurality of wound wire threads. Bundle cable connector assemblies have many applications for providing an electrical connection between various components. Each wire is typically mounted to a connector pin, and one or more connector pins are mounted to a connector body to provide the bundle cable connector assembly.

A series of assembly steps are used to couple the wire to the connector pin and the connector pins to the connector body to provide the bundle cable connector assembly. However, the known or conventional assembly steps typically produce bird cages, i.e., wire thread stretching and twisting, wires extending through the connector pin, loose wire threads, dielectric shield shrinking, etc., any one of which can provide a short circuit and/or wire thread grounding that affects the connector assemblies performance.

SUMMARY OF THE INVENTION

In accordance with the teachings of the present invention, a method is disclosed for assembling a bundle cable connector assembly that eliminates bird caging, wire threads extruding through a connector pin, loose wire threads, dielectric shield shrinking, etc. The method includes stripping the wire to create a bird cage preventative zone and an exposed tip with a crimping zone therebetween, and tinning the exposed wire at the bird cage preventative zone and the tip. The method then includes inserting the wire into a connector pin, and crimping the pin to the wire at the crimping zone using heat so that the tinning solder melts. The method then includes mounting the pin to a connector body and mounting a wire-locking device to the connector body to lock the pin to the connector body.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a method for assembling a bundle cable connector assembly is merely exemplary in nature, and is in no way intended to limit the invention or its applications or uses.

Figure 1:
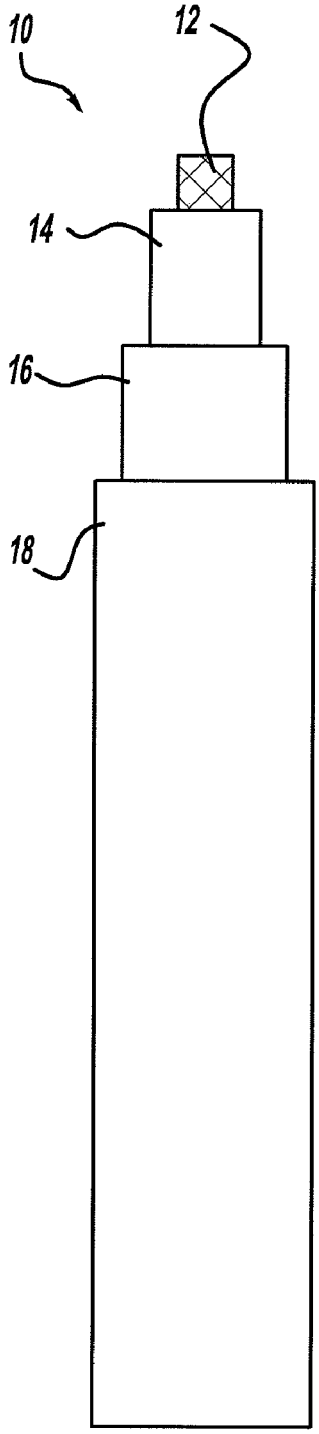
FIG. 1 is a side view of an electrical wire including an inner conductor and a metal ground shield.

FIG. 1 is a side view of a conventional electrical wire 10 including an inner conductor 12, a dielectric shield 14 surrounding the inner conductor 12, a metal ground shield 16 surrounding the dielectric shield 14 and an outer dielectric shield 18 surrounding the metal ground shield 16. The inner conductor 12 is a plurality of wound wire threads, as is well understood in the art. As is well understood in the art, electrical wires of this type come in different gauges that define the thickness of the wire.

Figure 2:
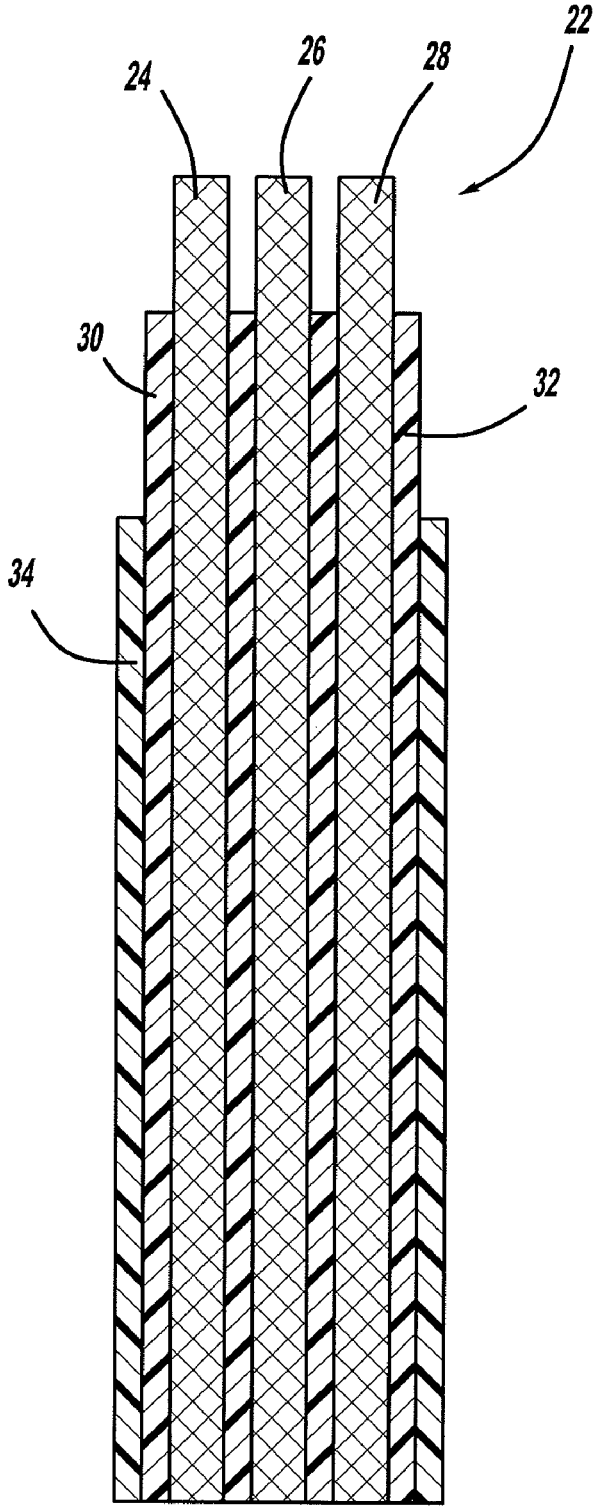
FIG. 2 is a cross-sectional view of an electrical wire including three inner conductors.

FIG. 2 is a cross-sectional view of a conventional electrical wire 22 including three inner conductors 24, 26 and 28 where the inner conductors 24 and 28 are surrounded by a dielectric shield 30 and 32, respectively, and an outer dielectric shield 34 is provided around the dielectric shields 30 and 32, as shown.

Figure 3:
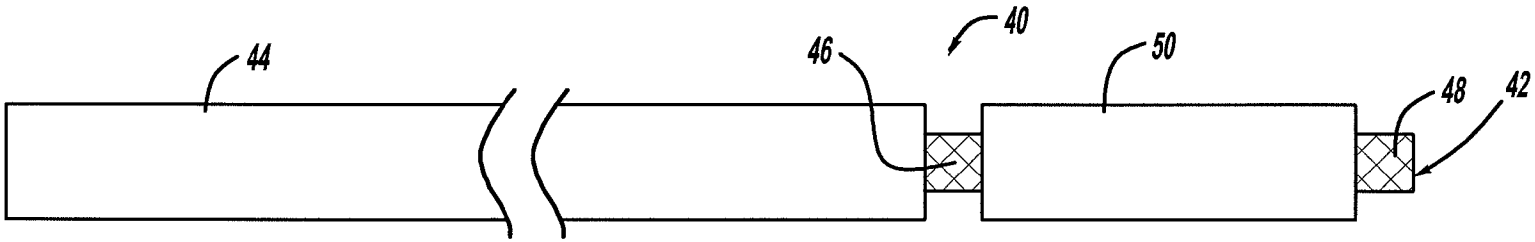
FIG. 3 is a side view of an electrical wire including an inner conductor and a dielectric shield that has been stripped to provide a bird cage preventative zone, a crimping zone and an exposed tip.

FIG. 3 is a side view of an electrical wire 40 including an inner conductor 42 and a dielectric shield 44. The wire 40 is intended to represent the conductor 12 and the dielectric shield 14 or the conductor 24 and the dielectric shield 30 or the conductor 28 and the dielectric shield 32. A suitable wire-stripping tool (not shown) removes a portion of the dielectric shield 44 to expose the inner conductor 42 at a tip 48. The dielectric shield 44 is then cut some distance from the tip 48 and the cut shield portion is slid towards the tip 48 to define a bird cage preventative zone 46. The slid piece of dielectric shield defines a crimping zone 50 between the bird cage preventative zone 46 and the tip 48.

Figure 4:
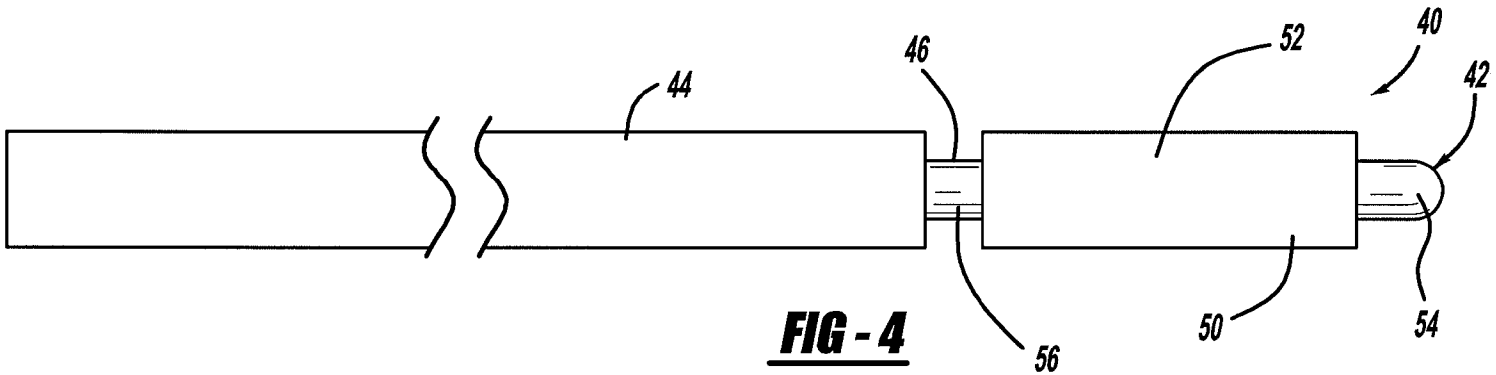
FIG. 4 is a side view of the electrical wire shown in FIG. 3 where the bird cage preventative zone and the tip have been tinned.

FIG. 4 is a side view of the electrical wire 40 where the exposed inner conductor 42 at the bird cage preventative zone 46 and the tip 48 have been tinned with a solder material to provide tinned regions 54 and 56, as shown. The dielectric shield in the crimping zone 50 remains on during the tinning process so the inner conductor 42 is not tinned in this region.

Figure 5:
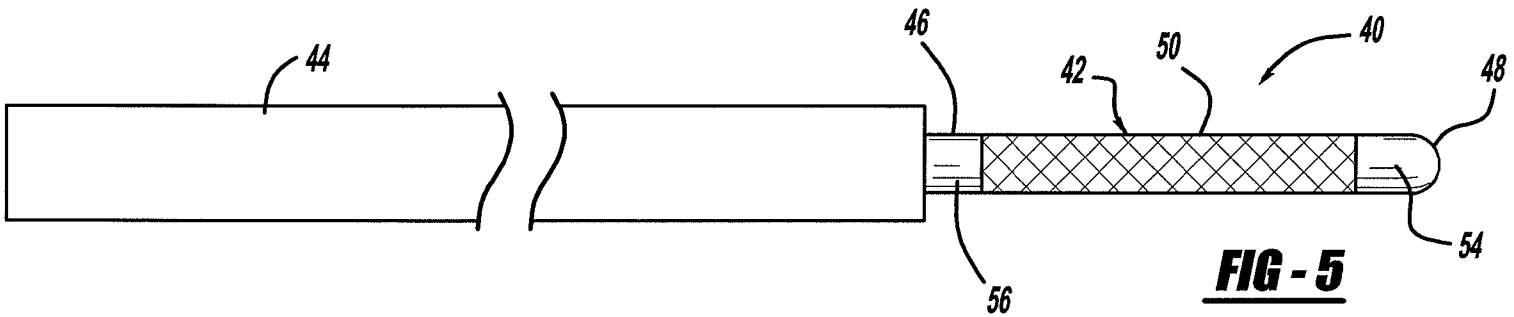
FIG. 5 is a side view of the electrical wire shown in FIG. 4 where the dielectric shield has been removed from the crimping zone.

FIG. 5 is a side view of the electrical wire 40 where the dielectric shield 44 is removed at the crimping zone 50 to expose the inner conductor 42 within.

Figure 6:
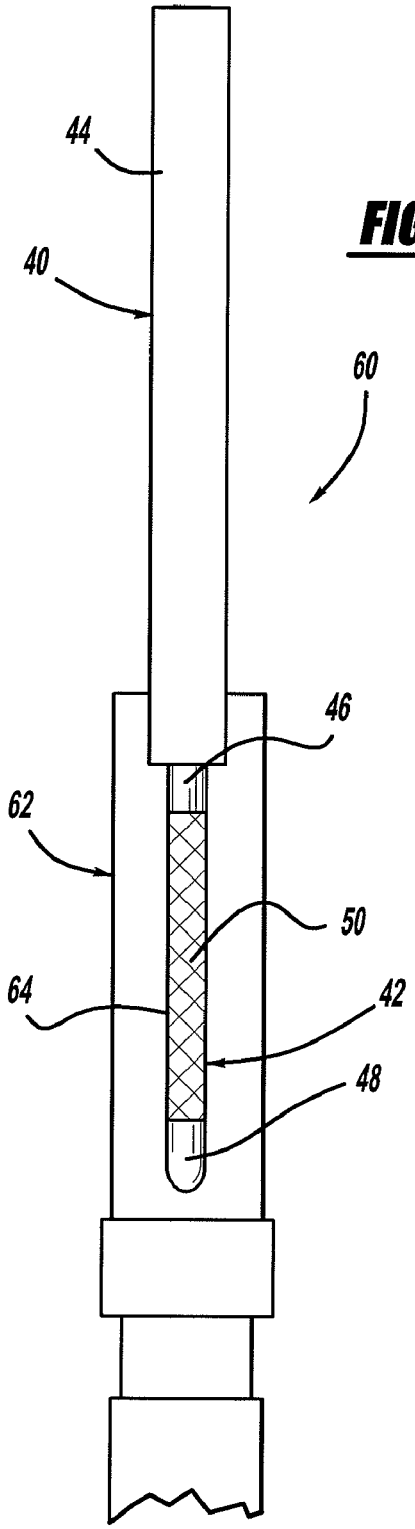
FIG. 6 is a side view of the wire shown in FIG. 5 positioned within a connector pin.

FIG. 6 is a side view of the electrical wire 40 shown in FIG. 5 inserted into a conductive connector pin 62 to provide a pin/wire assembly 60. Particularly, the pin 62 includes an internal bore 64 in which the end of the wire 40 is slid into so that the bird cage preventative zone 46 is completely positioned within the bore 64, as shown. The connector pin 62 is intended to represent either a male or female connector pin, many designs of which are known in the art.

Figure 8:
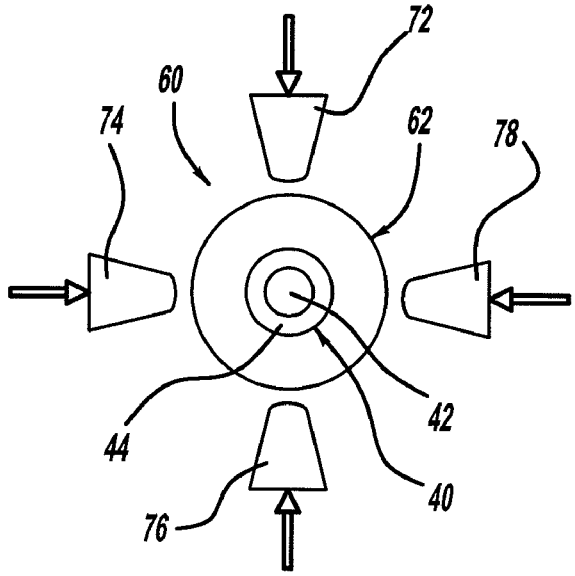
FIG. 8 is an end view of the wire/pin assembly within the crimping tool.
Figure 7:
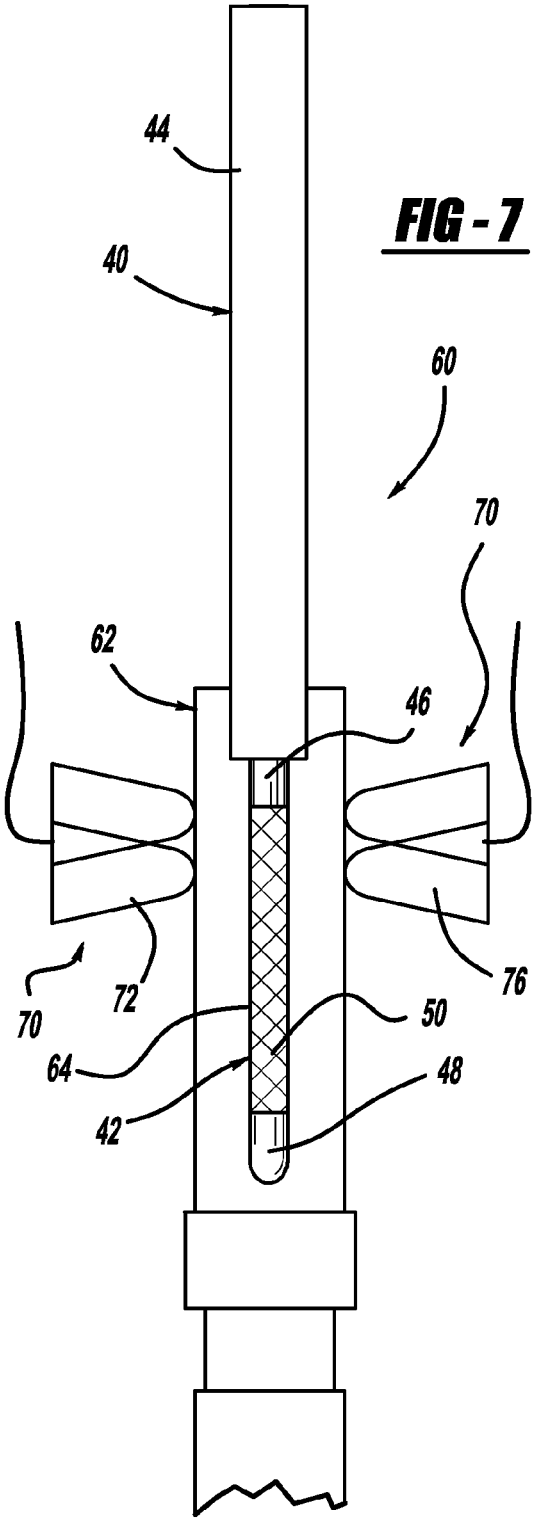
FIG. 7 is a side view of the wire/pin assembly shown in FIG. 6 positioned within a crimping tool.
Figure 9:
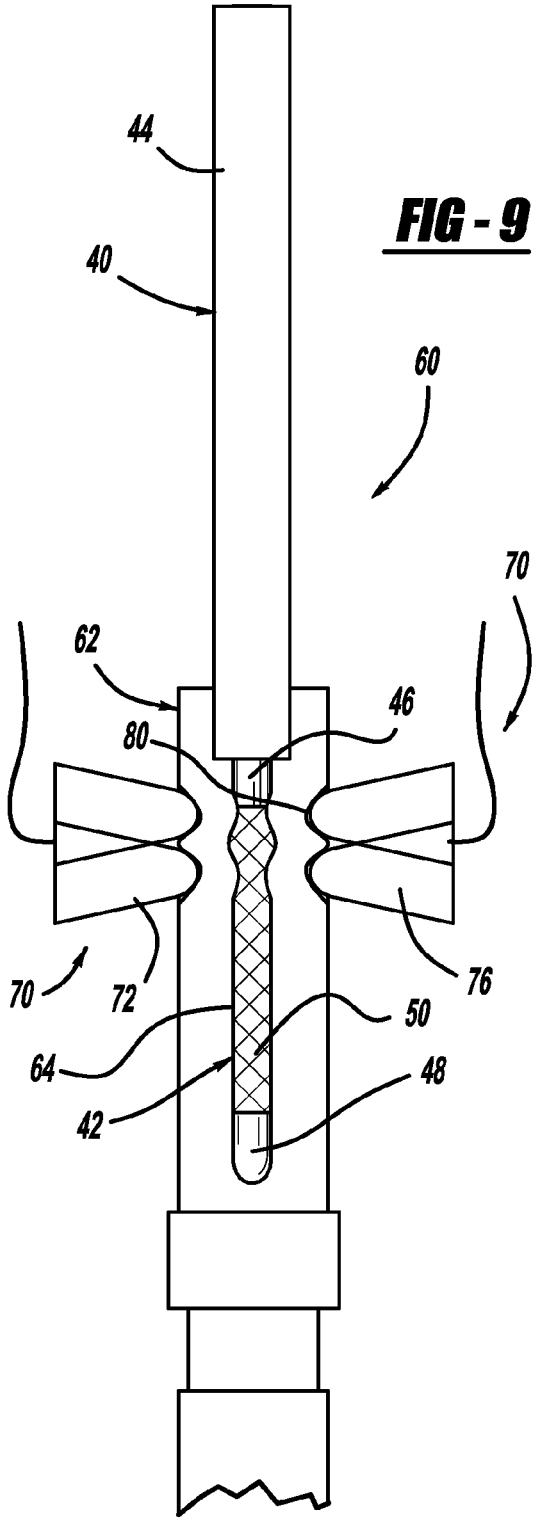
FIG. 9 is a side view of the wire/pin assembly shown in FIG. 6 after the pin has been crimped.

The connector pin 62 is crimped to the wire 40 so that it is secured thereto in an electrical connection. FIG. 7 is a side view and FIG. 8 is an end view of the pin/wire assembly 60 with a crimping tool 70 positioned relative thereto. The crimping tool 70 includes four electrodes 72, 74, 76 and 78 symmetrically positioned around the crimping zone 50, as shown. A force and an electrical current are provided to the electrodes 72-78 so that they apply pressure to the pin 62 and heat the pin 62, so that the pin 62 is crimped to the bird cage preventative zone 46 at the crimping zone 50 to provide a good electrical connection thereto. The heat generated by the electrodes 72-78 melts the solder to cause the solder to flow and further make an electrical connection. FIG. 9 is a side view of the pin/wire assembly 60 after the crimping process, where indentations 80 are formed in the connector pin 62, as shown.

Figure 10:
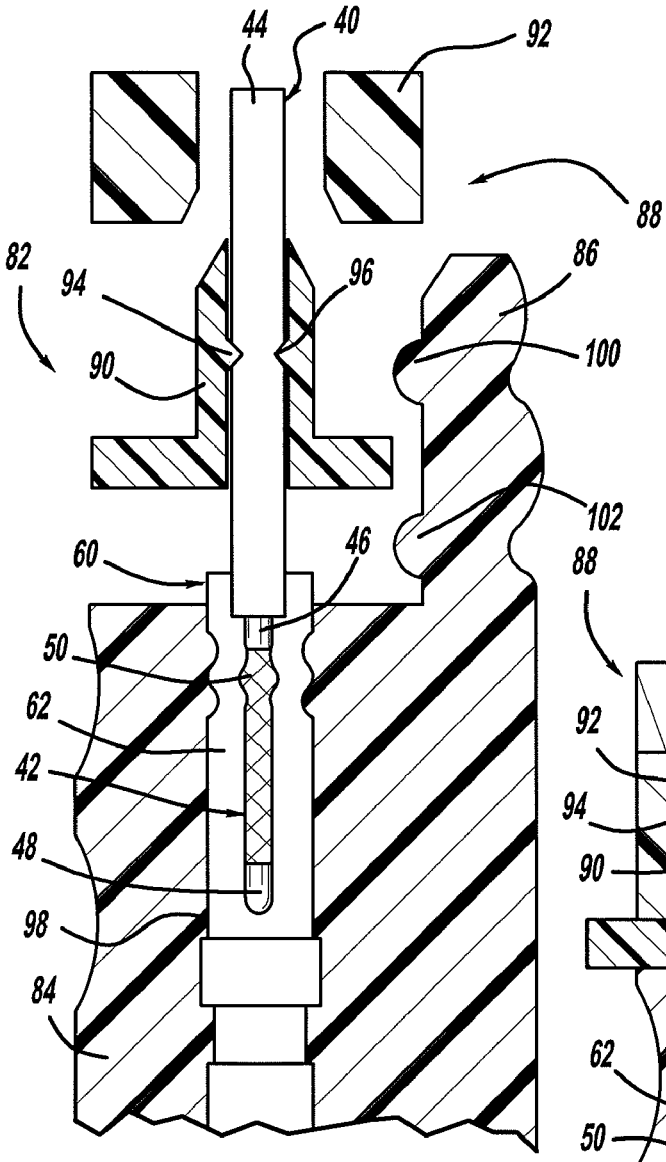
FIG. 10 is a side view of the crimped wire and pin assembly positioned within a connector body with a wire-locking device positioned relative thereto.

FIG. 10 is a cross-sectional view of a bundle cable connector assembly 82 including the pin/wire assembly 60. The connector assembly 82 is formed by inserting the pin 62 into a connector body 84, where the connector body 84 includes an annular rim 86. The connector body 84 is an insulating body, and is typically made of a suitable and durable plastic. A wire-locking device 88 including a T-shaped wire holding ferrule 90 and an annular locking ring 92 are positioned relative to the connector body 84. The holding ferrule 90 includes spikes 94 and 96 that are inserted into the dielectric shield 44. A tool (not shown) pushes the locking ring 92 against the holding ferrule 90 to drive the connector pin 62 into a bore 98 within the connector body 84. As the locking ring 92 moves downwards, the locking ring 92 locks between two annular rims 100 and 102 on an inside surface of the rim 86, as shown. Therefore, the wire-locking device 88 prevents the pin 62 from being pulled out of the connector body 82 through normal use. Although only a single pin 62 is shown connected to the connector body 84, it is typical that several of the pin/wire assemblies would be connected to a single connector body to provide multiple electrical connections to several wires. In one embodiment, the ferrule 90 and the ring 92 are made of a suitable plastic, and the number of connector pins mounted in the body 82 is in the range of 4-154.

Figure 11:
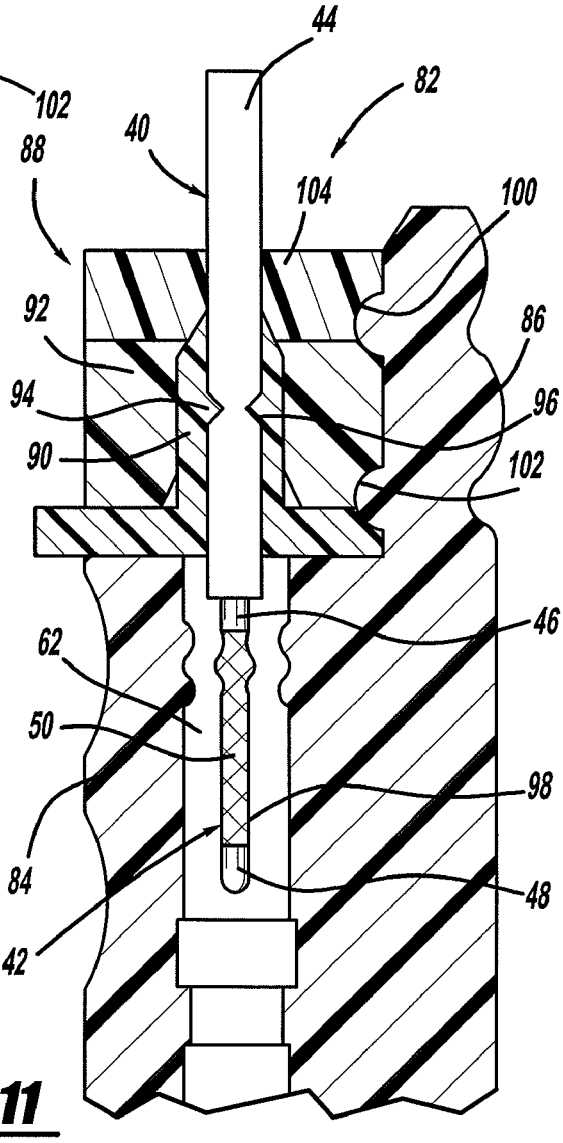
FIG. 11 is a side view of the connector assembly shown in FIG. 10 where the wire-locking device is mounted to the connector body.

FIG. 11 is a cross-sectional view showing the bundle cable connector assembly 82 in the assembled configuration. A suitable potting material 104 is deposited over the wire-locking device 88 to seal the connector assembly 82, and prevent moisture from entering the inner connector body 82.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A method for assembling a bundle cable connector assembly, said method comprising:

providing a least one electrical wire including an inner conductor and an outer dielectric shield;

stripping the dielectric shield from the at least one electrical wire to form an exposed tip portion, an exposed bird cage preventative zone and a crimping zone therebetween that includes the dielectric shield;

tinning the electrical wire by depositing a solder coating on the inner conductor at the bird cage preventative zone and the tip portion;

removing the dielectric shield around the crimping zone;

positioning the end of the wire including the tip portion, the crimping zone and the bird cage preventative zone within an internal bore of a connector pin;

crimping the connector pin proximate to the bird cage preventative zone and the crimping zone so as to electrically connect the inner conductor to the pin; and mounting the pin to a connector body.

2. The method according to claim 1 further comprising mounting a wire-locking device to the wire and the connector body.

3. The method according to claim 2 wherein mounting a wire-locking device to the wire and the connector body includes securing a holding ferrule to the wire and positioning a locking ring around the holding ferrule and between annular rims on the connector body.

4. The method according to claim 2 further comprising depositing a potting material over the wire-locking device.

5. The method according to claim 1 wherein crimping the connector pin proximate to the bird cage preventative zone and the crimping zone includes heating the inner conductor so as to melt the solder at the bird cage preventative zone.

6. The method according to claim 5 wherein crimping the connector pin proximate to the bird cage preventative zone and the crimping zone includes using a four probe crimping tool where each probe is spaced about 90° apart and where the probes receive an electrical current to provide the heating.

7. The method according to claim 1 wherein stripping the dielectric shield from the at least one electrical wire to form an exposed tip portion and an exposed bird cage preventative zone includes stripping a tip of the at least one wire, cutting the dielectric shield some distance from the tip and sliding the cut dielectric shield towards the tip to provide the exposed bird cage preventative zone.

8. The method according to claim 1 wherein providing a least one electrical wire including an inner conductor and an outer dielectric shield includes providing a plurality of electrical wires each crimped to separate pins and all mounted to the same at least one connector body.

9. The method according to claim 1 wherein the inner conductor includes a plurality of wound wire threads.

10. A method for assembling a bundle cable connector assembly, said method comprising:

providing a least one electrical wire including an inner conductor and an outer dielectric shield;

stripping the dielectric shield from the at least one electrical wire to form an exposed tip portion;

positioning the end of the wire including the tip portion within an internal bore of a connector pin;

crimping the connector pin so as to electrically connect the inner conductor to the pin;

mounting the pin to a connector body; and mounting a wire-locking device to the wire and the connector body where the wire-locking device holds the wire within the connector body.

11. The method according to claim 10 wherein mounting a wire-locking device to the wire and the connector body includes securing a holding ferrule to the wire and positioning a locking ring around the holding ferrule and between annular rims on the connector body.

12. The method according to claim 10 further comprising depositing a potting material over the wire-locking device.

13. The method according to claim 10 wherein crimping the connector pin includes using a crimping tool having a plurality of probes and heating the probes.

14. The method according to claim 13 wherein crimping the connector pin includes using a four probe crimping tool where each probe is spaced about 90° apart.

15. The method according to claim 10 wherein providing a least one electrical wire including an inner conductor and an outer dielectric shield includes providing a plurality of electrical wires each crimped to separate pins and all mounted to the connector body.

16. A method for assembling a bundle cable connector assembly, said method comprising:

providing a least one electrical wire including an inner conductor and an outer dielectric shield;

stripping the dielectric shield from the at least one electrical wire to form an exposed tip portion, an exposed bird cage preventative zone and a crimping zone therebetween that includes the dielectric shield;

tinning the electrical wire by depositing a solder coating on the inner conductor at the bird cage preventative zone and the tip portion;

removing the dielectric shield around the crimping zone;

positioning the end of the wire including the tip portion, the crimping zone and the bird cage preventative zone within an internal bore of a connector pin;

crimping the connector pin proximate to the bird cage preventative zone and the crimping zone so as to electrically connect the inner conductor to the pin, wherein crimping the connector pin proximate to the bird cage preventative zone and the crimping zone includes using a crimping tool having a plurality of probes where the probes receive an electrical current to heat the solder at the birdcage preventative zone;

mounting the pin to a connector body; and mounting a wire-locking device to the wire and the connector body where the wire-locking device holds the wire within the connector body and where mounting a wire-locking device to the wire and the connector body includes securing a holding ferrule to the wire and positioning a locking ring around the holding ferrule and between annular rims on the connector body.

17. The method according to claim 16 further comprising depositing a potting material over the wire-locking device.

18. The method according to claim 16 wherein stripping the dielectric shield from the at least one electrical wire to form an exposed tip portion and an exposed bird cage preventative zone includes stripping a tip of the at least one wire, cutting the dielectric shield some distance from the tip and sliding the cut dielectric shield towards the tip to provide the exposed bird cage preventative zone.

19. The method according to claim 18 wherein providing a least one electrical wire including an inner conductor and an outer dielectric shield includes providing a plurality of electrical wires each crimped to separate pins and all mounted to the connector body.

20. The method according to claim 16 wherein using a crimping tool having a plurality of probes includes using a crimping tool having four probes spaced about 90° apart.

* * * * *